US009610470B1

(12) United States Patent
Eshet

(10) Patent No.: US 9,610,470 B1
(45) Date of Patent: Apr. 4, 2017

(54) RESISTANCE TORQUE BAR SYSTEM

(71) Applicant: Alon Eshet, Hallandale Beach, FL (US)

(72) Inventor: Alon Eshet, Hallandale Beach, FL (US)

( * ) Notice: Subject to any disclaimer, the term of this patent is extended or adjusted under 35 U.S.C. 154(b) by 0 days.

(21) Appl. No.: 15/206,336

(22) Filed: Jul. 11, 2016

(51) Int. Cl.
*A63B 21/02* (2006.01)
*A63B 21/00* (2006.01)

(52) U.S. Cl.
CPC ..... *A63B 21/026* (2013.01); *A63B 21/4035* (2015.10)

(58) Field of Classification Search
CPC ..... A63B 21/026; A63B 21/4035; A63B 21/0004; A63B 21/00043; A63B 21/00185; A63B 21/02; A63B 21/04; A63B 21/045; A63B 21/0455; A63B 21/055; A63B 21/0555
See application file for complete search history.

(56) References Cited

U.S. PATENT DOCUMENTS 4,640,178 A * 2/1987 Kurzbock ..... D07B 1/02 87/1
4,856,776 A * 8/1989 Ching-Liang ..... A63B 21/045 482/122
5,031,906 A * 7/1991 Jang ..... A63B 21/0004 482/125
5,205,803 A * 4/1993 Zemitis ..... A63B 21/0552 482/121
5,397,288 A * 3/1995 Sayre ..... A63B 21/018 482/122
5,569,125 A * 10/1996 Clementi ..... A63B 21/045 482/126
5,885,196 A * 3/1999 Gvoich ..... A63B 21/0004 482/122
5,891,003 A * 4/1999 Deac ..... A63B 5/16 482/106
5,924,692 A * 7/1999 Rosenberg ..... A63F 9/32 273/153 R
7,794,374 B1 * 9/2010 Park ..... A63B 21/0004 482/122
7,827,895 B2 * 11/2010 Wang ..... A63B 21/00043 57/225

(Continued)

*Primary Examiner* — Loan H Thanh
*Assistant Examiner* — Megan Anderson
(74) *Attorney, Agent, or Firm* — 1st-Tech-Ideas: Haim M. Factor

(57) ABSTRACT

According to the teachings of the current invention, there is provided a resistance torque bar system for personal exercise, physical therapy, and fitness training, configured to provide progressive bending, explosive recoil, high tensile strength, natural twisted resistance force, and impact strength, the resistance torque bar system comprising: a torque bar having an elongated cylindrical shape, having an elongated length and a longitudinal axis, which in cross-section serves as an axis of symmetry, and having two bar ends; a high tensile cord configured along the longitudinal axis, within the torque bar; and a rod bundle configured substantially concentrically around the high tensile cord, and a reinforced hose enclosing and containing the rod bundle and the high tensile cord; wherein the high tensile cord, rod bundle, and reinforced hose extend substantially along the entire length of the torque bar, and terminate and are mechanically constrained in a longitudinal direction at the two bar ends.

2 Claims, 4 Drawing Sheets

(56) References Cited

U.S. PATENT DOCUMENTS

| | | | | |
|---|---|---|---|---|
| 8,105,215 | B2 * | 1/2012 | Wang | A63B 21/00043 24/300 |
| 2004/0152570 | A1 * | 8/2004 | Udwin | A63B 21/00043 482/128 |
| 2014/0221178 | A1 * | 8/2014 | Wagner | A63B 21/00043 482/126 |
| 2016/0045779 | A1 * | 2/2016 | Hasta | A63B 21/4037 5/417 |

* cited by examiner

Section A-A (b)

(a)

RESISTANCE TORQUE BAR SYSTEM

FIELD OF THE INVENTION AND BACKGROUND

The current invention relates to exercise and fitness equipment and devices in general, and specifically to a resistance torque bar system for personal exercise, physical therapy and fitness training.

In the specification and claim which follow hereinbelow, the term "torque" as used in "torque bar" is intended to have an equivalent meaning of "rotational force" and/or "resistance force"—both in response to a bending and/or twisting of a torque bar, as described hereinbelow. Additionally, in the specification and claim which follow hereinbelow, the term "bar", as used in "torque bar" is intended to mean an elongated cylindrical object, having a longitudinal axis, and which may be flexed substantially along its axis, as described further hereinbelow.

There are a number of exercise and fitness devices available for personal training. Among the Prior art which addresses this subject are, inter alia:

Rosenberg et al., in U.S. Pat. No. 5,924,692, whose disclosure is incorporated herein by reference, describe a multi-stable mechanical device. It is a bundle of rods surrounded by elastic, which when manipulated can be made to change from one stable close-packed state to another, causing a sudden rearrangement of the rods within the bundle, and producing a snapping noise or click which can be heard and felt with the fingers, and interesting visual effects due to the rearrangement of the rods. Possible applications of this invention are amusement devices, puzzles, science education, toys, executive pacifiers, hand exercisers, and physics and materials science demonstrations. Resistance bands and springs with handles at the ends thereof, while appearing to be chest exercising devices, are in fact not used for chest development. Specifically, when a spring or resistance band device is designed for a starting motion which is a "pulling apart" motion (an abduction motion at the shoulder joint), the exercise which is being performed creates a concentric muscle contraction of the back and shoulder muscles. Further, when the resistance is being released (an adduction motion at the shoulder joint), an eccentric contraction, again to the back and shoulder muscles, occurs. In both instances, for this type of device, neither motion significantly involves the chest muscles.

U.S. Pat. No. 5,891,003, whose disclosure is incorporated herein by reference, in which Deac et al. describe An exercise device for exercising the lower body of a person comprising an elongated spring bar which may or may not be provided with weights at the ends. A protective collar is provided centrally of the bar to permit the user to support the bar on the shoulders or on the back. The user springs up and down between an erected and squat position and the bar oscillates in phase with the user's movements such that in the squat position the bar forms a tension arc with the ends pointed downwardly while storing spring energy. As the user begins his upward movement the rebound of the bar adds initially, additional pressure on the participating muscles after which, as the tension is released and the user moves toward an erect position, the further rebound of the bar will enhance the upward movement.

Clementi et al., in U.S. Pat. No. 5,569,125, whose disclosure is incorporated herein by reference, describe a twist and flex upper body shaping exercise device comprising a pair of handles gripped by the hands of a person. A structure extends between the handles, for generating resistance when the handles are twisted in opposite directions by the hands of the person. This causes the resistance generating structure to be flexed spirally, so that the muscles in the hands, arms and shoulders of the person will be toned up.

US Patent Application no. 20140221178, whose disclosure is incorporated herein by reference, in which Wagner et al. describe a resistance band system which includes one or more resistance bands, and a pair of handles which secure the ends of the one or more resistance bands. Each handle locks onto one of the ends of each resistance band. The handle is adapted to grip the resistance band with greater force when force is applied to the resistance band, such as when it is in use. The handle unlocks to release the ends of one or more of the resistance bands from the handles for changing of one or more of the resistance bands.

Haider, in German Application Patent no. DE10125215, whose disclosure is incorporated herein by reference, describes a kinetic therapy device made of elastic material having a rod-shaped structure with a central handle which is constructed of a number of individual high quality spring steel wires. Among preferred features are: a number of weights and damping elements fixed on the rod-shaped structure using fixing screws. The end pieces have a hemispherical end. The device is used for relaxing tense muscles.

U.S. Pat. No. 5,755,649, whose disclosure is incorporated herein by reference, in which Bimby describes a device comprising a free-standing, floor mounted base unit having extending therefrom a pair of pivoting sleeves. Inserted into the sleeves, in an easily removable manner, are a pair of levers. In use, the chest exercising device allows for a full range of adduction and abduction chest exercising arm movements, which movements are easily adjustable for resistance and, due to the pivoting movement of the sleeves, impingement at the shoulder joint is prevented.

"The Bullworker", whose disclosure is incorporated herein by reference, is a device sold by Hughes Marketing, LLC, 8433 N. Black Canyon Highway, Suite 100, Phoenix, Ariz. 85021 USA. It is a compression spring device incorporated within a telescoping pair of tubular cylinders. Additionally, the device has resistance bands and springs with handles. The Bullworker is constructed so that there is a fixed length to the device, which is significantly less than the required length for the starting position (full adduction) for a chest adduction exercise. Furthermore, a full range of motion in adduction is not available with the Bullworker due to the construction of the device, which inhibits a user from fully compressing his hands together because the user's hands could, at most, only ever be as close (at maximum adduction) as the length of the longest tubular member. Therefore a full range of motion is not available at the ending position (full adduction).

The prior art solutions noted hereinabove have shortcomings including, but not limited to: incomplete adduction exercising, overall heavy design, difficultly to store, and non-ergonomic exercise movement.

There is therefore a need to provide a lightweight and strong resistance torque device for personal exercise and fitness training.

SUMMARY OF INVENTION

According to the teachings of the current invention, there is provided a resistance torque bar system for personal exercise, physical therapy, and fitness training, configured to provide progressive bending, explosive recoil, high tensile strength, natural twisted resistance force, and impact strength, the resistance torque bar system comprising: a torque bar having an elongated cylindrical shape, having an elongated length and a longitudinal axis, which in cross-section serves as an axis of symmetry, and having two bar ends; a high tensile cord configured along the longitudinal axis, within the torque bar; and a rod bundle configured substantially concentrically around the high tensile cord, and a reinforced hose enclosing and containing the rod bundle and the high tensile cord; wherein the high tensile cord, rod bundle, and reinforced hose extend substantially along the entire length of the torque bar, and terminate and are mechanically constrained in a longitudinal direction at the two bar ends. Preferably, at least one D-handle is mechanically attached to either or both of the bar ends. Most preferably, the high tensile cord protrudes through a base of the D-handle and the protrusion of high tensile cord is formed into a loop and configured to serve as a safety strap to enhance handle grip. Typically, an adapter-handle pair includes an adapter piece securely fastened to a handle piece, the adapter-handle pair having a distal end at the adapter piece and a proximal end at the handle piece. Most typically, the handle piece is permanently mechanically connected and sealed to the torque bar at either or both ends of the bar and the adapter piece is configured to allow direct interchanging of an attachment, the attachment configured to be interchangeably connected at the distal end. Typically, the attachment is at least one chosen from the list including: a detachable D-handle; a detachable impact ball; a detachable spear head; and a detachable straight bar termination piece. Most typically, a lubricant is introduced within the within the reinforced hose and the two bar ends are sealed against moisture and dust.

According to the teachings of the present invention there is further provided method of using a resistance torque bar system personal exercise, physical therapy, and fitness training, configured to provide progressive bending, explosive recoil, high tensile strength, natural twisted resistance force, and impact strength, including the steps of: forming a torque bar having an elongated cylindrical shape, having an elongated length and a longitudinal axis, which in cross-section serves as an axis of symmetry, and having two bar ends; configuring a high tensile cord along the longitudinal axis, within the torque bar; and positioning a rod bundle substantially concentrically around the high tensile cord, and using a reinforced hose to enclose and constrain the rod bundle and the high tensile cord; whereby the high tensile cord, rod bundle, and reinforced hose extend substantially along the entire length of the torque bar, and terminate and are mechanically constrained in a longitudinal direction at the two bar ends. Preferably, at least one D-handle is mechanically attached to either or both of the bar ends. Most preferably, the high tensile cord protrudes through a base of the D-handle and the protrusion of high tensile cord forms a loop and serves as a safety strap to enhance handle grip. Typically, an adapter-handle pair includes an adapter piece securely fastened to a handle piece, the adapter-handle pair having a distal end at the adapter piece and a proximal end at the handle piece. Most typically, the handle piece is permanently mechanically connected and sealed to the torque bar at either or both ends of the bar and the adapter piece allows direct interchanging of an attachment, the attachment interchangeably connected at the distal end. Preferably, the attachment is at least one chosen from the list including: a detachable D-handle; a detachable impact ball; a detachable spear head; and a detachable straight bar termination piece. Most preferably, a lubricant is introduced within the reinforced hose and the two bar ends are sealed against moisture and dust.

LIST OF FIGURES

The invention is herein described, by way of example only, with reference to the accompanying drawings, wherein.

Figure 3:
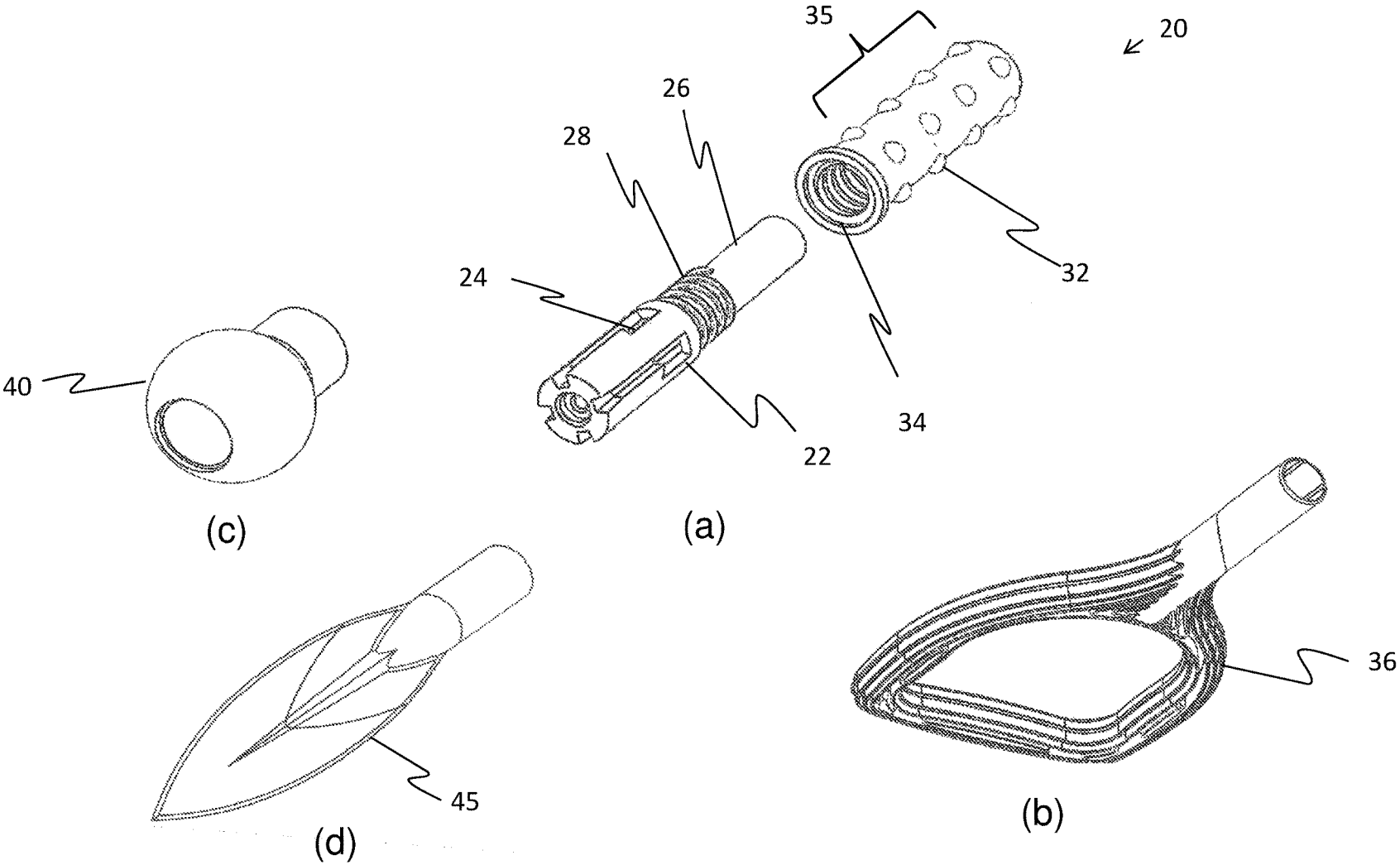
Figure 4:
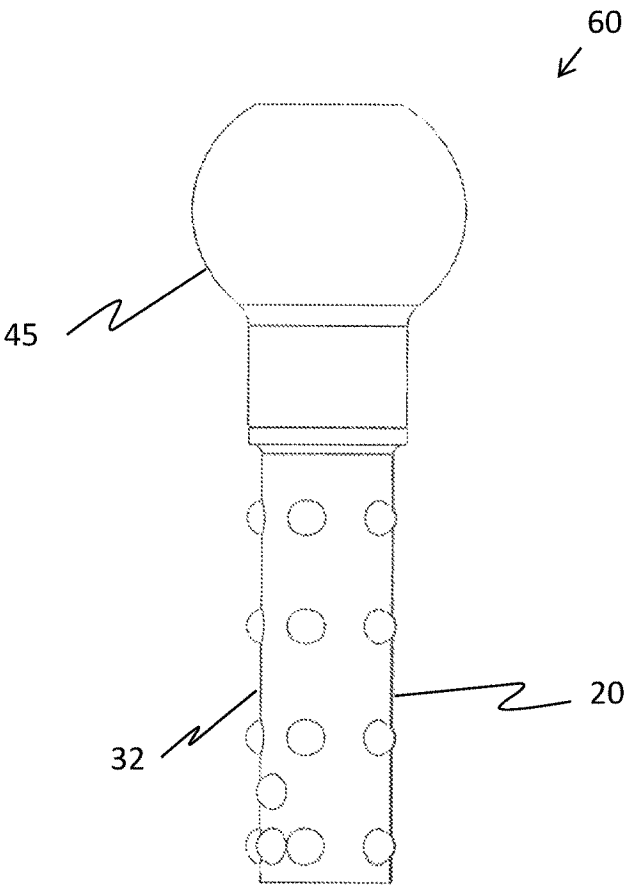
Figure 4:
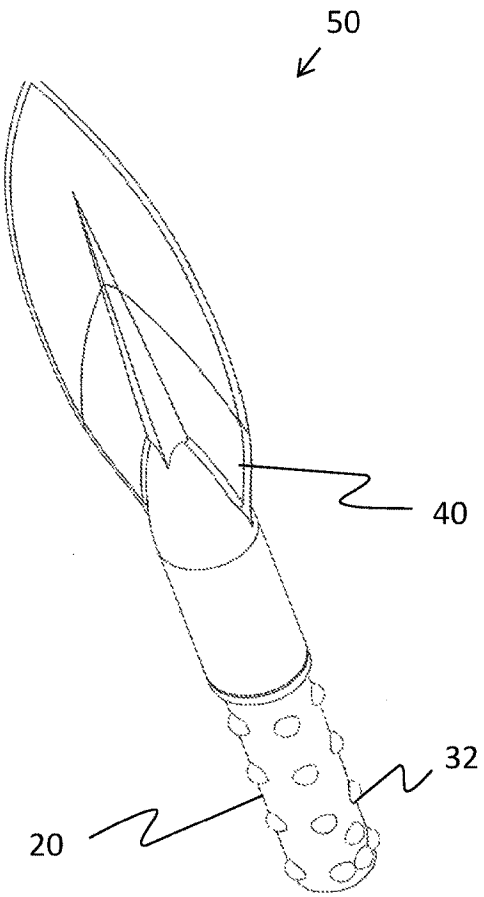

FIG. 3 is a is a collection of exemplary isometric views of attachments to the resistance torque bar system (shown in FIG. 1), including an adapter-handle pair, a detachable D-handle; a detachable impact ball, and a detachable spear head, in accordance with embodiments of the current invention; and FIG. 4 shows exemplary isometric views of a spear head assembly and an impact ball assembly, respectively, in accordance with embodiments of the current invention.

DETAILED DESCRIPTION

Embodiments of the present invention relate to exercise and fitness equipment and devices in general, and specifically to a resistance torque bar system for personal exercise, physical therapy and fitness training.

Figure 1:
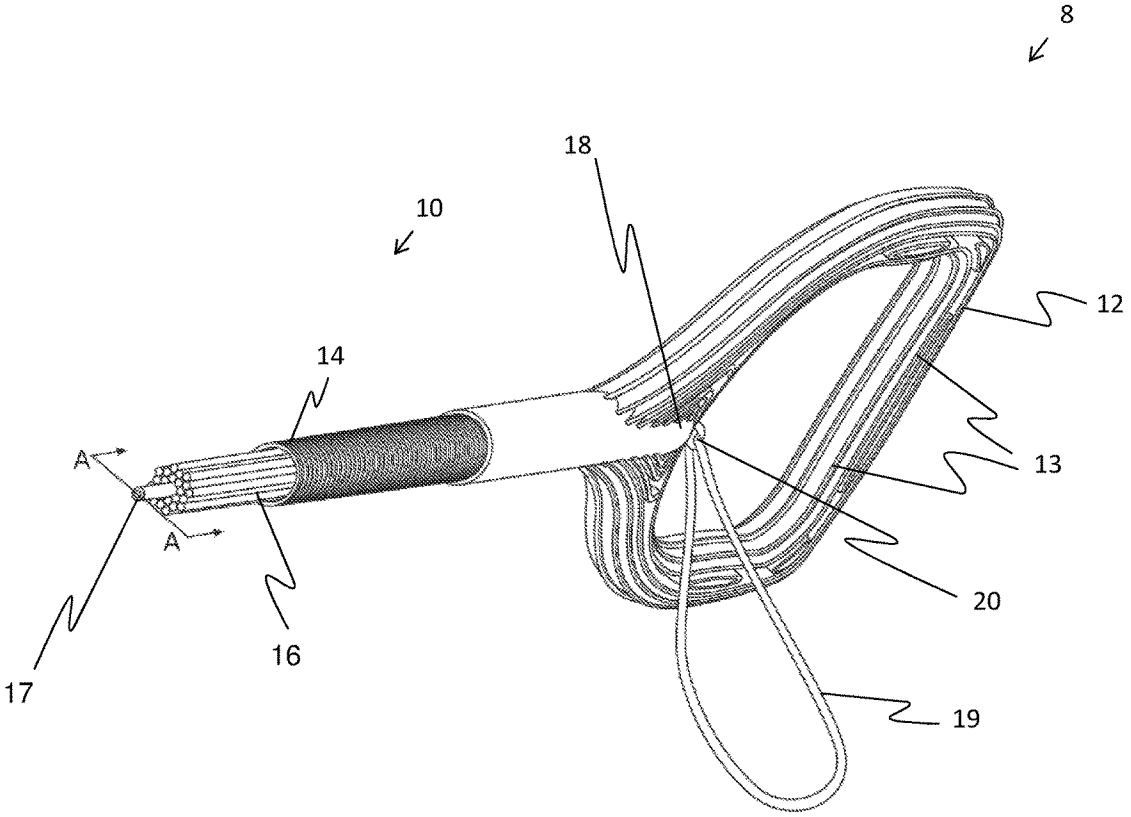
FIG. 1 is an isometric view of one end of a resistance torque bar system for personal exercise, physical therapy, and fitness training, in accordance with embodiments of the current invention.

Reference is currently made to FIG. 1, which is an isometric view of one end of a resistance torque bar system 8 for personal exercise, physical therapy, and fitness training, in accordance with embodiments of the current invention. The resistance torque bar system includes a torque bar 10, having two ends, each of which, in an embodiment of the current invention, terminates in a D-handle 12 (only one end of the torque bar is shown in the current figure). Torque bar 10 includes a reinforced hose 14 which restricts and encloses a rod bundle 16 and a high tensile cord 17 along the entire length of torque bar 10—with reinforced hose 14 and the rod bundle being shown partially removed in the figure for clarity.

Figure 2:
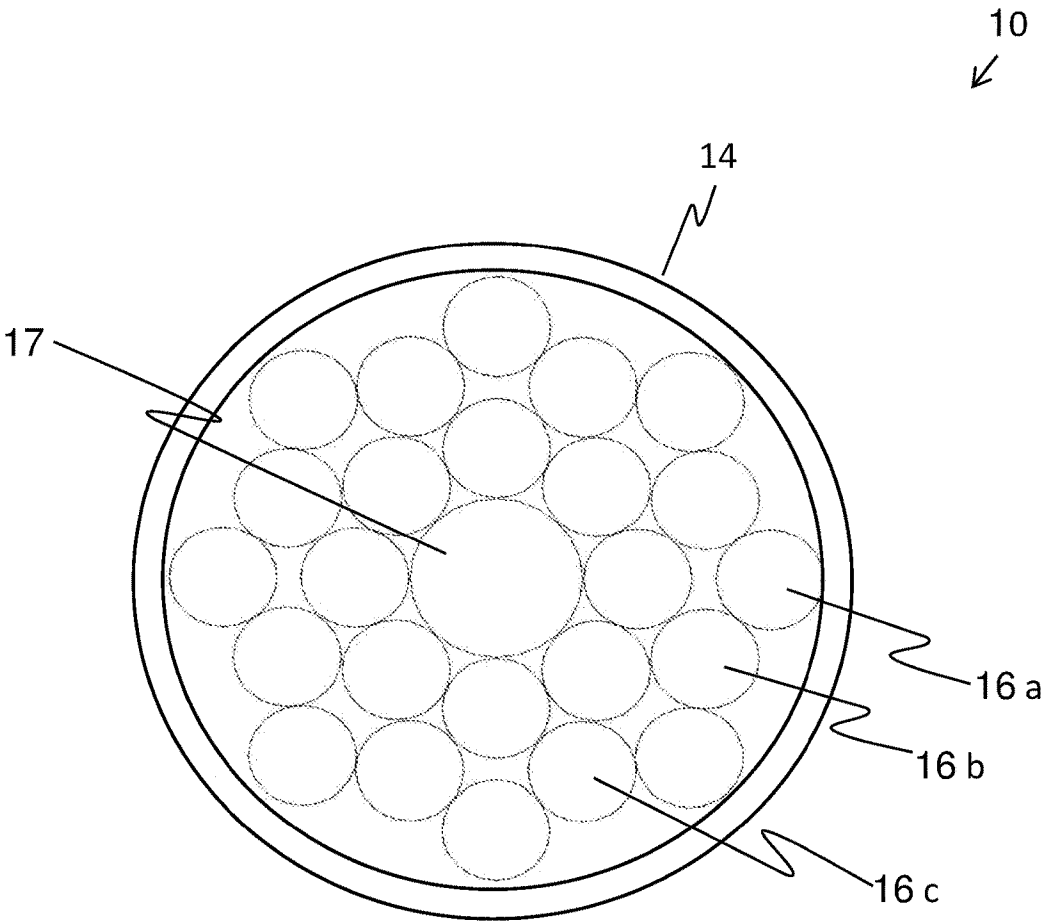
FIG. 2 is a cross-sectional view of the torque bar shown in FIG. 1 in accordance with embodiments of the current invention.

Reference is currently made to FIG. 2, which is a cross-sectional view of torque bar 10 shown in FIG. 1, in accordance with an embodiment of the current invention. Apart from differences described below, torque bar 10 is identical in notation, configuration, and functionality to that shown in FIG. 1, and elements indicated by the same reference numerals and/or letters are generally identical in configuration, operation, and functionality as described hereinabove. As is apparent in FIGS. 1 and 2, torque bar 10 has a longitudinal axis, which in cross section (FIG. 2) is an axis of symmetry, about which are substantially concentrically configured: high tensile cord 17; then rod bundle 16; and then reinforced hose 14. The tensile cord, rod bundle, and reinforced hose extend substantially along the entire length of torque bar 10, and terminate and are mechanically constrained in a longitudinal direction at both bar ends.

Resistance torque bar system 8 has an overall typical length ranging from approximately 59 to 63 inches. Torque bar 10 has a typical length of approximately 48 inches. Construction of the torque bar and its structure and materials (including high tensile cord 17; then rod bundle 16; and then reinforced hose 14) as described further hereinbelow, serve to provide progressive bending, explosive recoil, high tensile strength, and impact strength.

Rod bundle 16 includes a plurality of exemplary rods 16*a*, 16*b*, and 16*c* which surround a centrally, coaxially-configured high tensile cord 17, as shown, especially in FIG. 2. Individual rods (ie 16*a*, 16*b*, 16*c*) of the rod bundle each have an approximate diameter of ⅛ inch and are made of durable, flexible, and strong materials such as, but not limited to fiberglass and unsaturated fiberglass. Rod bundle 16 and high tensile cord 17 are configured to fit snugly within reinforced hose 14. Reinforced hose 14 is made from a strong waterproof material, such as, but not limited to polyethylene having an integrated cord/mesh (such as found in reinforced garden hose, as known in the art). Reinforced hose 14 has an approximate outer diameter of 1 inch and an approximate inner diameter of ¾ inch. In an embodiment of the current invention rod bundle 16 and high tensile cord 17 are lubricated with a lubricant such as, but not limited to: grease, paraffin oil, and graphite. Rod bundle 16 and high tensile cord 17 are sealed within reinforced hose 14, against moisture and dust, as known in the art. In this way, reliable flexing and long-term performance of the torque bar is ensured.

Fiberglass rods D-handle 12 has a general "D" shape, allowing a comfortable and firm grasp of the handle. Additionally, the D-handle has integrated ribs 13—as shown in the figure—to enhance grip and to provide a no-slip/low-slip surface, such as when grasped by hands that perspire. Additionally, the ribs provide therapeutic "accu-pressure" points and have a therapeutic effect on the hand and knuckles when grasped. The D-handle may be formed from injection molded materials or other lightweight strong materials such as, but not limited to metals, plastics, wood, and resins.

In an embodiment of the current invention, D-handle 12 is permanently mechanically connected and sealed to torque bar 10, with high-tensile cord 17 protruding through a base 18 of handle 12 and further forming a loop (otherwise called a "safety strap" 19). High-tensile cord 17 is mechanically constrained at the protrusion through the base of the handle so that the cord may not translate out of either end of torque bar 10 and/or out of either handle. In one embodiment of the current invention, the mechanical constraint is affected by a knot 20 formed in high tensile cord 17 at the respective bases of the two D-handles. The safety strap is large enough to pass a hand through—to enhance/ensure handle grip, as known in the art, and/or to serve as constraining mechanism to hold the handle of one end of torque bar 10 against another handle, such as when torque bar 10 is flexed and stowed. In an embodiment of the current invention, high tensile cord is made from Kevlar® cord, ranging from approximately ¼ to ⅛-inch diameter.

Reference is currently made to FIG. 3, which is a collection of isometric views of exemplary attachments to resistance torque bar system 8 (shown in FIG. 1), including an adapter-handle pair 20 (view (a)), a detachable D-handle 36 (view (b)); a detachable impact ball 40 (view (c)), and a detachable spear head 45 view (d), in accordance with embodiments of the current invention.

Adapter-handle pair 20 includes an adapter piece 22 and a handle piece 32. Adapter piece 22 includes: insertion grooves 24; an insertion shaft 26; and a threading spring 28. Insertion grooves 24 serve to receive quick-attachable: detachable D-handle 35; detachable impact ball 40; and detachable spear head 45—all as described further hereinbelow. Part or all of detachable spear head 45 and/or detachable impact ball 40 may be fabricated from a hard and/or sharpenable material, such as but not limited to aluminum, steel, plastic, or steel-reinforced plastic.

Threading spring 28 may be tightly connected to shaft 26 by spring tension of threading spring 28 upon the shaft—and/or by suitable adhesive and/or bonding, as known in the art. Handle piece 32 is securely fastened to adapter piece 22 by means of securely turning the handle piece relative to the adapter piece and engaging threading spring 28 into a female threading 32 within handle piece 32, as indicated in the figure. In this way, a short-displacement spring force may be imparted by handle piece 32 and by threading spring 28 on an object longitudinally pressing against handle piece 32, as further described hereinbelow. In another embodiment, handle piece 32 may additionally be securely fastened to adapter piece 22 by use of a suitable adhesive and/or bonding—both as known in the art.

Handle piece 32 is made from a comfortably-gripped material—which may be formed by injection processes—such as, but not limited to: polypropylene, an acetyl resin, and a polypropylene-resin combination. Additionally, handle piece 32 has a plurality of protrusions 36 located around the periphery of the handle piece to enhance gripping.

Detachable D-handle 36; detachable impact ball 40; and detachable spear head 45 all have a female quick-attach receiving structure (not shown in the figures) to receive adapter piece 22 and insertion grooves 24, so that when any of the detachable pieces are positioned over and pushed onto adapter piece 22, adapter piece 22 is inserted into the female quick-attach receiving structure, thereby engaging insertion grooves 24. Additionally, upon further pushing of any of the detachable pieces longitudinally against the handle piece 32 and then turning the respective detachable piece less than ¼ turn to the right, the detachable piece is locked into place by way of the spring force described hereinabove and as known in the art.

In an embodiment of the current invention, adapter-handle pair 20 is permanently mechanically connected and sealed to torque bar 10 (ref FIGS. 1 and 2), at either or both ends of the bar, instead of D-handle 12 (ref FIG. 1). The connection of adapter-handle pair 20 to either one or both ends of torque bar 10 thereby allows direct interchanging of detachable D-handle 36; detachable impact ball 40; and detachable spear head at either end of the torque bar.

Although three exemplary attachments are shown in FIG. 4, additional attachment configurations and pieces—such as, but not limited to: a detachable straight bar termination piece and other sizes and variations of the impact ball—may be used.

Reference is currently made to FIG. 4, which are exemplary isometric views of a spear head assembly 50 (view (a)) and an impact ball assembly 60 (view (b)), respectively, in accordance with an embodiment of the current inventions. Spear head assembly 50 includes the detachable spear head 40 and adapter-handle pair 20—ref FIG. 3, views (c) and (a). Impact ball assembly 60 includes detachable impact ball 40 and adapter-handle pair 20—ref FIG. 3, views (d) and (a). (Note that in FIG. 4, both spear head assembly 50 and an impact ball assembly 60 shown adapter-handle pair 20 inserted and locked within each of the respective assemblies, so that adapter piece 22 of FIG. 3 is not seen.) In a similar fashion—but not shown in the current figure—detachable handle 36 is inserted and locked onto adapter-handle pair 20.

In an embodiment of the current invention, adapter-handle pair 20 is not connected to bar 10 (ref FIGS. 1 and 2) and spear head assembly 50 and an impact ball assembly 60 may be grasped directly by handle 32 of the adapter-handle pair. Such a configuration is useful for martial arts and survival training, inter alia.

Among the varied uses and applications of resistance torque bar system 8 are the ability to:

Provide a natural torque resistance (i.e. natural twisted resistance force) of bar 10 while it is bent and/or flexed; as the bar is bent/flexed, a resisting, torsional force is created from the rod bundle realigning within the bar;

Create functional resistance when torque bar 10 is flexed and therefore to provide a more realistic body training;

Simulate natural body position and provide muscle support needed while in impact postures; and Uniquely enable a combination of pull, push, twist, torque, bend, shake, and whip motions, while major muscle groups are fully extended.

Among other features of the resistance torque bar system are:

While torque bar 10 is flexed, the resistance torque bar system serves to activate arms and legs in virtually all ranges of movement with multiple angles while providing continuous resistance;

The unique shape and contour of the D Handle enables a user to trigger virtually all muscles in the wrists and ankles for complete motion and to enhance muscle rehabilitation; and The resistance torque bar system is lightweight and relatively inexpensive to manufacturer.

Resistance torque bar system 8 is designed for activities such as, but not limited to: commercial fitness workouts; physical therapy; outdoor survival tasks; exhaustive military use and training; and martial arts sparring and training regimes. In therapeutic use, the resistance torque bar system provides physical conditioning and full muscle extension without the use of weights Military and special forces applications are achieved by interchangeable-purpose accessories—as described hereinabove—for combat and survival conditions, both on terrestrial and marine environments.

The construction of torque bar 10 and its materials enables progressive bending, explosive recoil, high tensile strength, and impact strength.

While activating major and functional combined muscles groups, the resistance torque bar system also contributes to ensure joint and health stability while affording a full range of motion in many functional positions, such as, but not limited to: wrists; knuckles; shoulders; elbows; ankles; knees; hips; and including a full range of arm and leg movement.

It will be appreciated that the above descriptions are intended only to serve as examples, and that many other embodiments are possible within the scope of the present invention as defined in the appended claims.

The invention claimed is:

1. A resistance torque bar system for personal exercise, physical therapy, and fitness training, configured to provide progressive bending, explosive recoil, high tensile strength, natural twisted resistance force, and impact strength, the resistance torque bar system comprising:

a torque bar having an elongated cylindrical shape, having an elongated length and a longitudinal axis, which in cross-section serves as an axis of symmetry, and having two bar ends;

a high tensile cord configured along the longitudinal axis, within the torque bar;

a rod bundle, including a plurality of rods, each rod having an approximate diameter of ⅛ inch, configured substantially concentrically around the high tensile cord, and a reinforced hose enclosing and constraining the rod bundle and the high tensile cord;

at least one D-handle is mechanically attached to either or both of the bar ends;

the high tensile cord protruding through a base of the D-handle and the protrusion of high tensile cord formed into a loop and configured to serve as a safety strap to enhance handle grip; and a lubricant introduced within the reinforced hose and the two bar ends are sealed against moisture and dust, wherein the high tensile cord, rod bundle, and reinforced hose extend substantially along the entire length of the torque bar, and terminate and are mechanically constrained in a longitudinal direction at the two bar ends.

2. A method of using a resistance torque bar system for personal exercise, physical therapy, and fitness training, configured to provide progressive bending, explosive recoil, high tensile strength, natural twisted resistance force, and impact strength, including the steps of:

forming a torque bar having an elongated cylindrical shape, having an elongated length and a longitudinal axis, which in cross-section serves as an axis of symmetry, and having two bar ends;

configuring a high tensile cord along the longitudinal axis, within the torque bar;

positioning a rod bundle, including a plurality of rods, each rod having an approximate diameter of ⅛ inch, the rod bundle, substantially concentrically around the high tensile cord, and using a reinforced hose to enclose and to constrain the rod bundle and the high tensile cord;

mechanically attaching at least one D-handle to either or both of the bar ends;

the high tensile cord protrudes through a base of the D-handle and the protrusion of high tensile cord forms a loop and serves as a safety strap to enhance handle grip; and introducing a lubricant within the reinforced hose and the two bar ends are sealed against moisture and dust, whereby the high tensile cord, rod bundle, and reinforced hose extend substantially along the entire length of the torque bar, and terminate and are mechanically constrained in a longitudinal direction at the two bar ends.

* * * * *